United States Patent [19]

Scoville

[11] 3,962,065

[45] June 8, 1976

[54] CHLORINE GAS OR HYPOCHLORITE PRODUCING APPARATUS

[76] Inventor: Frank J. Scoville, 4646 South 3075 East, Salt Lake City, Utah 84117

[22] Filed: Apr. 14, 1975

[21] Appl. No.: 567,681

Related U.S. Application Data

[63] Continuation-in-part of Ser. No. 473,678, May 28, 1974, abandoned.

[52] U.S. Cl. ..... 204/256; 204/95; 204/98; 204/255; 204/257; 204/263

[51] Int. Cl.[2] ..... C25B 1/14; C25B 1/16; C25B 1/26

[58] Field of Search ..... 204/95, 98, 255, 256, 204/257, 263, 269, 301

[56] References Cited

UNITED STATES PATENTS

| | | | |
|---|---|---|---|
| 1,360,541 | 11/1920 | Levin | 204/256 |
| 2,717,872 | 9/1955 | Zdansky | 204/256 |
| 3,152,062 | 10/1964 | Clusius et al. | 204/257 X |
| 3,288,652 | 11/1966 | Leavitt | 204/256 X |
| 3,323,653 | 6/1967 | Lacey et al. | 204/301 X |

*Primary Examiner*—T. Tung
*Assistant Examiner*—A. C. Prescott
*Attorney, Agent, or Firm*—Criddle, Thorpe & Western

[57] ABSTRACT

Apparatus for producing a chlorine gas or a hypochlorite compound comprising a housing, a plurality of carbon electrodes arranged in series, with electrodes being spaced to form chambers between adjacent electrodes and one or more hollow tubes extending through the electrodes for delivering a chloride salt brine solution to the chambers. Each chamber is divided into an anode compartment and a cathode compartment by a chloride ion permeable membrane. A fluid sealing ring or rings around the outside perimeter of each electrode and around each hollow tube separates the permeable membrane from each electrode thereby dividing each chamber into an anode compartment and a cathode compartment divided by the membrane. The salt solution is applied to a hollow tube and flows through apertures therein into each anode compartment. A negative D.C. current is supplied to the electrode on one end of the series of electrodes and a positive D.C. current is supplied to the electrode on the other end to thereby induce a chlorine gas producing reaction in the chambers. When producing a hypochlorite the housing has means whereby the chlorine gas, hydrogen and alkali or alkaline earth hydroxide may be intermixed. When elemental chlorine is desired, the housing has a plurality of hollow tubes extending through the electrodes one of which opens into the anode chamber through which the chlorine is allowed to escape and the other opening into the cathode chamber through which hydrogen gas and the alkali or alkaline earth hydroxide may be withdrawn.

13 Claims, 6 Drawing Figures

CHLORINE GAS OR HYPOCHLORITE PRODUCING APPARATUS

RELATED APPLICATIONS

This application is a continuation-in-part of Ser. No. 473,678 filed May 28, 1974, now abandoned.

BACKGROUND OF THE INVENTION

This invention concerns a simple and compact apparatus for producing either chlorine gas or a hypochlorite compound.

Production of a chlorine releasing compound in the form of chlorine gas or a hypochlorite is important for a number of reasons including the use of disinfecting swimming pool water. Perhaps the most economical method of producing chlorine and hypochlorite compounds involves the application of an electric current to an alkali or alkaline earth metal chloride solution. In general, the resulting reaction yields the desired chlorine gas at the anode and hydrogen gas and an alkali or alkaline earth metal hydroxide at the cathode according to the following equation:

$$2Na^+ + 2Cl^- + 2H_2O \rightarrow 2Na^+ + 2OH^- + Cl_2 + H_2 \quad (1)$$

Present arrangements for producing chlorine gas in this manner typically employ pairs of electrodes disposed in separate cells containing salt (sodium chloride) brine solution. Other arrangements may employ a number of electrodes disposed in a single cell with the electrodes connected in parallel. In the latter arrangement, a fairly high D.C. current but low voltage must be applied to the electrodes to cause a chlorine gas producing reaction in the cell. The fairly high current is required since the electrodes are connected in parallel and a certain amount of current must be applied to each electrode before the gas producing reaction will take place. Along with the higher current requirement, a lower voltage is also required and this would be obtained from a conventional A.C. source using some type of step-down transformer. The combination of the high current requirement and a low voltage requirement gives rise to a need for fairly large conductors to carry the current, rectifiers having large current carrying capacity, and fairly large transformers for "stepping-down" the voltage.

The U.S. Pat. No. 3,835,020 issued Sept. 10, 1974, to Galneder, a chlorine producing apparatus is disclosed wherein the electrodes are connected in series and allegedly result in the production of chlorine, oxygen and hydrogen. No separation is made in the electrode chambers into anode and cathode compartments and hence all products produced as a result of electrolysis are vented by the same exit port. Since chlorine reacts readily with hydrogen to form hydrogen chloride it is questionable whether such an apparatus would produce any usable chlorine compound for purification purposes.

When using chlorine or a hypochlorite for water treatment purposes, there are a variety of chemical reactions that can and do take place. When chlorine gas is introduced into a water solution the chlorine molecule per se may interact with contaminants contained in the water supply. On the other hand, chlorine in water reacts according to Equation 2 to form hypohalous acid and hydrogen chloride:

$$Cl_2 + 2H_2O \rightarrow HOCl + HCl + H_2O \quad (2)$$

Hypohalous acid in turn reacts as shown in Equation 3 to form hydrogen chloride and nascent oxygen:

$$HOCl + H_2O \rightarrow HCl + O_2 + H_2O \quad (3)$$

It is the interaction of the nascent oxygen with the contaminants in the water which brings about additional purification. Thus it can be readily seen that in many instances it is desirable to introduce chlorine gas directly into a water supply so that both chlorine and oxygen may be used for purification purposes.

On the other hand, it is often desirable to use a hypochlorite as the disinfecting or purification reagent. When the electrolysis products from Equation 1 are combined, chlorine reacts with sodium hydroxide or other alkali or alkaline earth metal hydroxides to form sodium hypochlorite or the appropriate alkali or alkaline earth metal hypochlorite and hydrogen chloride according to Equation 4:

$$H_2O + Cl_2 + NaOH \rightarrow NaOCl + HCl + H_2O \quad (4)$$

The more alkaline the solution is the more rapid the conversion of chlorine into the hypochlorite will be. Sodium hypochlorite in aqueous solution forms sodium chloride and nascent oxygen according to Equation 5:

$$2NaOCl + H_2O \rightarrow 2NaCl + O_2 + H_2O \quad (5)$$

The oxygen released interacts with the contaminants in the water to oxidize them thereby bringing about water purification.

SUMMARY OF THE INVENTION

It is an object of the present invention to provide a simple and compact apparatus for producing either chlorine gas or hypochlorite compounds.

It is also an object of the present invention to provide chlorine gas or hypochlorite compound producing apparatus which requires relatively low current and high voltage.

It is a further object of the present invention to provide a chlorine or hypochlorite compound producing apparatus in which a plurality of electrodes are arranged in series in a cell with the electrode compartments being divided by a permeable membrane into cathode and anode compartments.

It is another object of the present invention to provide a chlorine or hypochlorite compound producing structure wherein the chlorine can be withdrawn in the gaseous stage from the anode compartment and hydrogen and an alkali or alkaline earth metal hydroxide withdrawn from the cathode compartment.

It is still another object of the present invention to provide a chlorine or hypochlorite producing apparatus wherein the products from both the cathode and anode compartments can be intermixed and withdrawn as hypochlorites.

The above and other objects and advantages of the present invention are realized in a specific illustrative embodiment which includes a housing, a multiplicity of electrodes arranged in series in the housing with the electrodes being spaced to form chambers therebetween. The chambers are in turn divided by a chloride ion permeable membrane into anode and cathode compartments. The compartments are defined by a gasket or other sealing means which separates the electrodes from the chloride ion permeable membrane. One or more hollow tubes extend through the electrodes, one of which tubes is used for delivering an alkali or alkaline earth metal chloride salt solution to the anode portion of the chambers. Two other hollow tubes traversing the electrodes contain apertures which are contiguous with the anode compartments for one hollow tube and the cathode compartments for the other hollow tube, thereby providing means for withdrawing chlorine gas from the anode compartment and an alkali or alkaline earth metal hydroxide and hydrogen gas from the cathode compartment. The apparatus has means for supplying a D.C. current in series to the electrodes.

BRIEF DESCRIPTION OF THE DRAWINGS

The above and other objects and advantages of the present invention will become apparent from the following detailed description presented in connection with the accompanying drawings in which.

DETAILED DESCRIPTION

Figure 1:
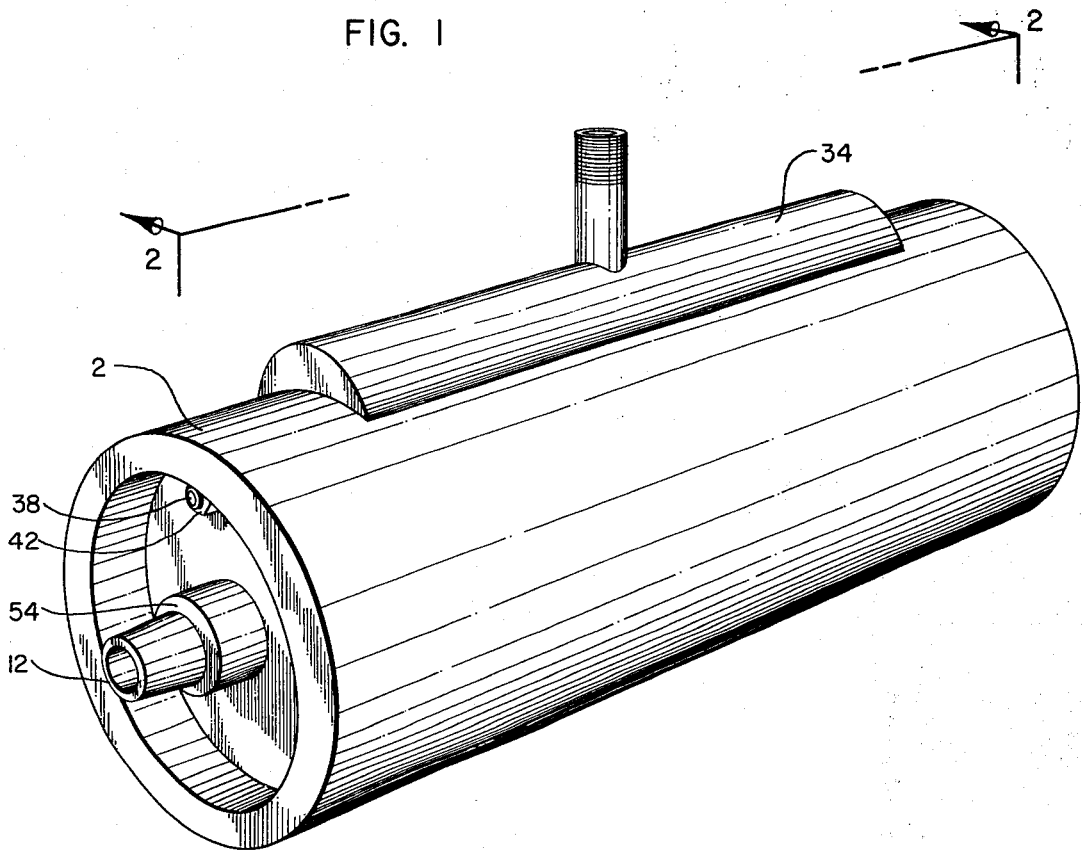
FIG. 1 is a perspective view of a hypochlorite gas producing apparatus made in accordance with the principles of the present invention containing one hollow tube traversing the electrodes.
Figure 2:
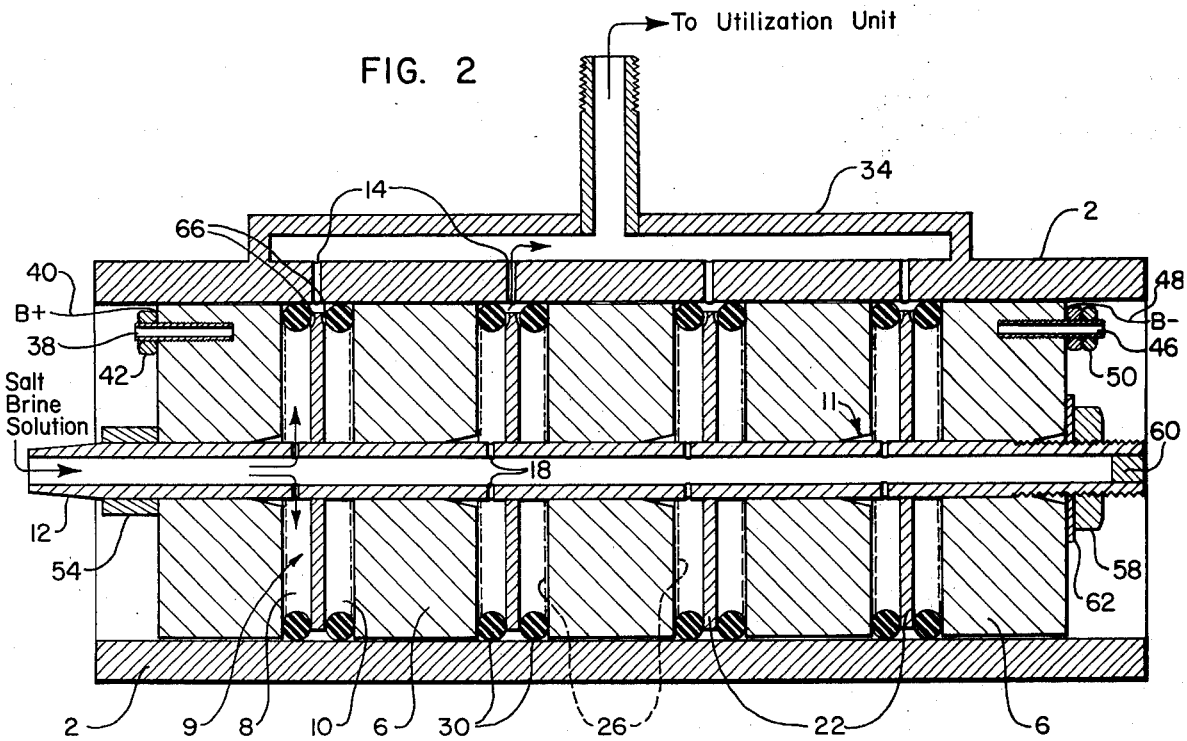
FIG. 2 is a cross-sectional view of the apparatus of FIG. 1.
Figure 3:
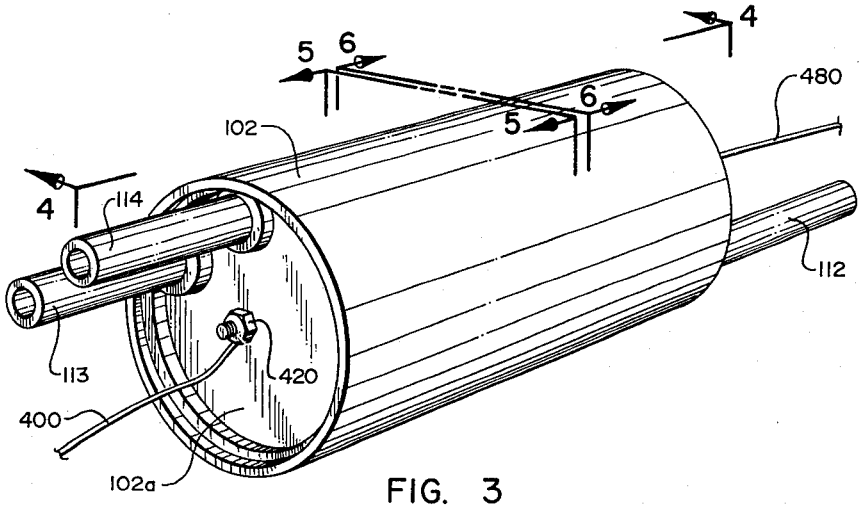
FIG. 3 is a perspective view of a chlorine gas producing apparatus having separate outlet tubes for products formed in the anode and cathode compartments.

The hypochlorite producing apparatus shown in FIGS. 1 and 2 includes a cylindrically-shaped casing or housing 2 open at either end for receiving thereinto the rest of the apparatus necessary for producing the hypochlorite solution. A plurality of oil impregnated carbon electrode plates or discs 6 having holes therein are mounted on a hollow tube 12 by inserting the tube through the holes. When so mounted, the planes defined by the discs are substantially parallel with each other and are perpendicular to the tube. The circumferences of the discs 6 are substantially the same as the interior circumference of the housing 2 so that the discs fit snugly within the housing as shown in FIGS. 1 and 2. The discs 6 are spaced along the tube to define chambers 9 between adjacent discs. For the embodiment shown in FIGS. 1 and 2 there are five carbon electrode discs and four chambers 9 formed by the spacing of the discs. Of course, more or fewer discs could be utilized depending upon the hypochlorite producing capacity desired.

The carbon electrode disc on the left end of the series of discs is coupled electrically to a positive D.C. current source B+. This is accomplished by inserting a screw 38 into the disc, attaching a wire or other conductor 40 to the screw 38, and then screwing a nut 42 onto the screw to secure the wire. The carbon electrode disc at the other end of the series of discs is coupled electrically to a negative D.C. current source B−. This is also done by inserting a screw 46 into the disc, attaching a wire 48 to the screw and then screwing a nut 50 onto the screw. The screws 38 and 46 might illustratively be made of copper, brass, titanium or other inert conductive material.

Chloride ion permeable membranes 22 are mounted on the tube 12 and positioned in each of the chambers 9 to divide the chamber into two compartments 8 and 10. The compartment nearer the positive D.C. current source B+ may be referred to as the anode compartment and the compartment nearer the negative D.C. current source B− may be referred to as the cathode compartment. Thus, each chamber is divided into an anode compartment 8 and a cathode compartment 10 by a membrane 22. The membranes 22, which are disc shaped as shown in the drawings, might illustratively be made of porous polypropylene or other plastic material suitable for allowing diffusion of a salt brine solution therethrough and of the passage of alkali or alkaline earth metal ions and chloride ions, but for inhibiting the free passage of chlorine gas or a chlorine saturated solution from the anode compartment to the cathode compartment since this would result in the electrochemical reduction of the dissolved chlorine, i.e., conversion of the chlorine back to chloride ions (the process of producing chlorine for chloride ions will be discussed later).

A water and alkali or alkaline earth metal chloride (salt brine) solution supplied to the hollow tube 12 flows therethrough and through apertures 18 in the tube 12 into each of the anode compartments 8. As indicated above, the membranes 22 allow diffusion therethrough of the salt brine solution so that the solution applied to the anode compartments will also diffuse into the cathode compartments. To prevent the flow of salt brine solution from the compartment through any space which might exist between the perimeters of the carbon electrode discs 6 and the interior wall of the housing 2, a plurality of plastic or elastomer rings 30 are provided. A ring is included in each compartment to maintain contact with a corresponding carbon disc and the interior wall of the housing 2 to seal the compartment. Each pair of rings 30 in a chamber also contact a membrane 22 positioned therebetween. The rings might illustratively be constructed of a suitable, flexible chemical and heat resistant material.

As hereinafter described more fully, chlorine gas produced in the anode compartments and hydrogen gas and alkali or alkaline earth metal hydroxide (preferably sodium hydroxide) produced in the cathode compartments are allowed to flow out of the compartments through bypass ports 66, formed in the membranes 22, and apertures 14 located in the housing 2. The rings 30 contact the corresponding membrane 22 about the circumference of the membrane except for that part of the membrane in which the bypass ports are located.

The carbon electrode discs 6, a membranes 22, and rings 30 are held in place on or about the tube 12 by a nut 58 and a washer 62 fitted on a threaded end of the tube 12, and a retaining ring 54 fitted on the other end of the tube 12. The assembly of the tube 12, carbon electrode discs, membranes and rings are fitted into the housing 2. The opposite end of the tube from which the salt brine solution is received is stopped by a plug 60.

A jacket 34 is attached to the exterior surface of the housing 2 over the apertures 14 to intermix the chlorine gas produced in the anode compartments with hydrogen and the metal hydroxide, preferably sodium hydroxide, formed in the cathode compartments. The jacket 34 simply defines a chamber and guide exterior to the housing 2 for intermixing the anode and cathode products and passing them on to the utilization unit (not shown).

When salt brine solution (sodium chloride) is supplied to the compartments 8 and 10 and positive and negative D.C. current is supplied to each respective end most ones of the carbon electrode discs, the electrodes are thereby coupled in what may be termed a series electrical circuit. This causes a reaction to take place in each of the anode compartments resulting in the production of chlorine gas. This reaction, which is well known, involves the conversion of chloride ions in the salt brine solution into chlorine gas at the interface between the carbon electrodes and the salt brine solution. The chlorine gas produced in the anode compartment flows through the bypass ports 66 and the apertures 14 into the chamber defined by the jacket 34. The reaction at the interface of the carbon electrodes and the salt brine solution tends to cause the formation of bubbles at the interface. To break up the bubbles and prevent gas passivation, thin screens 26 are positioned adjacent each carbon electrode-salt brine solution interface. These screens or "defoamers" might illustratively be constructed of 18 mesh fluorocarbon screen or other suitable non-corrosive material.

The reaction which takes place in the cathode compartments results in the production of an alkali or alkaline earth metal hydroxide, preferably sodium hydroxide, and hydrogen gas. These products also flow through the bypass ports 66 and apertures 14 into the chamber formed by the jacket 34. Chlorine reacts readily with sodium hydroxide. Thus when chlorine is passed into a solution of sodium hydroxide, a solution containing sodium chloride and sodium hypochlorite is produced. The sodium hypochlorite is then passed on to a utilization unit.

Figure 4:
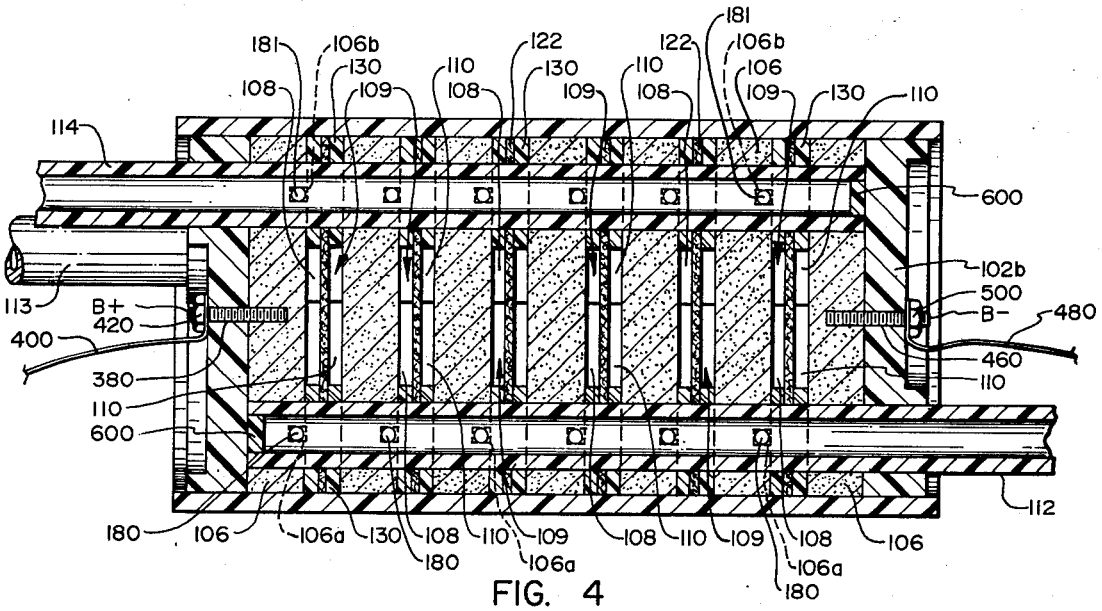
FIG. 4 is a cross-sectional view of the apparatus of FIG. 3 taken along lines 4—4.
Figure 5:
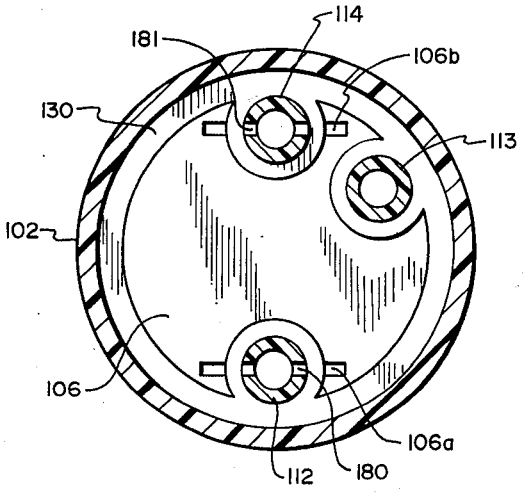
FIG. 5 is a cross-sectional view showing the anode compartment of the apparatus of FIG. 3 taken along lines 5—5.
Figure 6:
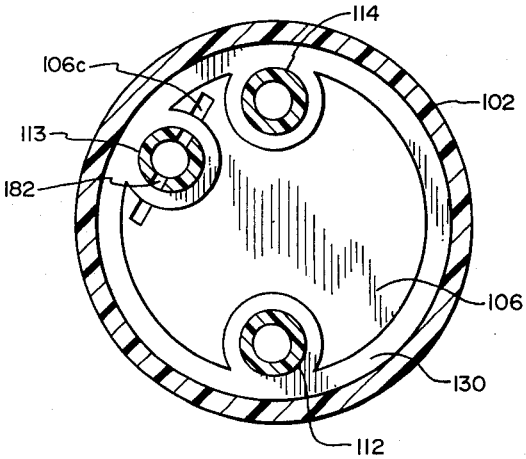
FIG. 6 is a cross-sectional view showing the cathode compartment of the apparatus of FIG. 3 taken along lines 6—6.

The chlorine gas producing apparatus as shown in FIGS. 3 to 6 includes a cylindrically shaped casing or housing 102 open at either end for receiving thereinto the rest of the apparatus necessary for producing the chlorine gas. A plurality of oil impregnated carbon electrode plates or discs 106 having three holes therein are mounted on hollow tubes 112, 113 and 114 by inserting the tubes through the holes. When so mounted the planes defined by the discs are substantially parallel with each other and are perpendicular to the tubes. The circumferences of the discs 106 are substantially the same as the interior circumference of the housing 102 so that the discs fit snugly within the housing as shown in FIGS. 4, 5 and 6. The discs 106 are spaced along the tube to define chambers 109 between adjacent discs. For the embodiment shown in FIGS. 3 through 6 there are seven carbon electrode discs and six chambers 109 formed by the spacing of the discs. Of course, more or fewer discs could be utilized depending upon the chlorine gas producing capacity desired.

The carbon electrode discs on the extreme left and right end of the series of discs are coupled to a positive and negative D.C. current respectively as described for the apparatus illustrated in FIGS. 1 and 2.

Chloride ion permeable membranes 122 are mounted on the tubes 112, 113 and 114 and positioned in each of the chambers 109 to divide the chambers into two compartments 108 and 110. The compartment 108 nearest the positive D.C. source current B+ 108 may be referred to as the anode compartment, and the compartment 110 near the negative D.C. current source B− 110 may be referred to as the cathode compartment. Thus each chamber 109 is divided into an anode compartment 108 and a cathode compartment 110 by membrane 122. The membranes 122 which are disc shaped as shown in the drawings might illustratively be made of porous polyethylene or other plastic material suitable for allowing diffusion of a salt brine solution as previously described for FIGS. 1 and 2.

While the invention heretofore has been described in terms of utilization of an alkali or alkaline earth metal chloride such as lithium, sodium, potassium, magnesium, or calcium chlorides, the invention will hereinafter be referred to with reference to sodium chloride which is the preferred embodiment.

A water and sodium chloride solution supplied to hollow tube 112 flows into tube 112 and through apertures 180 into each of the anode compartments 108. As indicated above, the membranes 122 allow diffusion therethrough of the sodium chloride solution so that the solution applied to the anode compartments will also diffuse into cathode compartments 110. To prevent the flow of sodium chloride solution from the anode or cathode compartments through any space which might exist between the perimeters of the carbon electrode discs 106 and the interior wall of the housing 102, a plurality of plastic or elastomer gaskets or rings 130 are provided. The ring 130 is included in each compartment to separate the electrode 106 from the chloride permeable membrane 122. The ring maintains contact with each carbon electrode 106 and the interior wall of housing 102 to seal the compartment. Each pair of rings or gaskets are also so formed as to encircle the outer periphery of hollow tubes 112, 113 and 114 thereby providing a fluid tight seal so that the products from the anode compartment, i.e., chlorine gas and products from the cathode compartment, i.e., hydrogen gas and sodium hydroxide will not intermix with each other in chamber 109. These rings are constructed of any suitable flexible material which is chemically and heat resistant to the operation being carried out.

The electrode compartments 108 and 110 and the elastomer ring 130 are more clearly illustrated in FIGS. 5 and 6. As illustrated in each of these FIGS. the electrode is surrounded on the outer side by housing 102 and each electrode has three holes bored therein through which pass hollow tubes 112, 113 and 114. An elastomer ring 130 is so configured as to seal the outer perimeter of the electrode 106 against the sides of the housing 102 and also to encircle the outer perimeter of each of hollow tubes 112, 113 and 114. Preferably, the ring 130 is of unitary construction, however, if desired, it could be made of separate pieces which would encircle the outer perimeter of the electrode and which would then fit in gasketlike relationship around each hollow tube.

Referring now to FIGS. 4 and 5, indentations **106*a* and 106*b* are made in electrode 106 adjacent to the hole through which tubes 112 and 114 pass. These indentations may be on either side across the diameter of the hole or may be on one side of the hole only. These indentations are made in the same direction on each electrode so as to be in alignment. Indentations 106*a* and 106*b* extend past the periphery of the elastomer ring 130 so as to provide an opening into the anode compartment. Hollow tube 112 passing through the electrode contains holes 180 contiguous to indentation 106*a* thereby providing a means of entry of salt solution into the anode side of the electrode compartment. In other words, solution entering through tube 112 will flow through opening 180 into indentation 106***a* and into anode compartment 108.

In like manner hollow tube 114 contains openings 181 which are contiguous to indentation 106*b* thereby providing an outlet through which the chlorine gas formed in the anode side of the compartment may flow and exit out through hollow tube 114.

The cathode side of the electrode as illustrated in FIG. 6 is similar and contains an indentation 106*c* in the third hole or opening of the electrode 106. Hollow tube 113 having openings 182 which are contiguous with indentation 106*c* pass through the electrodes in such a manner that the products formed in cathode compartment 110, i.e., hydrogen gas and sodium hydroxide, may exit by holes 182 into hollow tube 113 and be disposed of in a desirable manner. Each of the hollow tubes contains a plug or seal at the end designated as 600 and each housing has endwalls 102*a* and 102*b* which are securely engaged in housing 102 by means of lamination or other appropriate means to keep the electrodes in fixed relationship to each other.

As explained for FIGS. 1 and 2, the carbon electrode disc at the left hand of the embodiment illustrated in FIGS. 3 through 6 is coupled electrically to a positive D.C. current source B+. As in the earlier drawings this is accomplished by inserting a screw 380 through the endwall of the housing 102*a* and into the end electrode 106 and attaching a nut 420 onto the screw to secure a conductor wire 400. The carbon electrode disc at the extreme right end of the series of discs is coupled electrically to a negative D.C. current source B−. This is done by inserting a screw 460 through the endwall of housing 102*b* and into the end electrode 106. A wire 480 is attached to the screw and a nut 500 secures the wire to the screw. As previously mentioned, screws 380 and 460 might illustratively be made of copper, brass, titanium or other inert conductive material.

As previously described, the chloride ion permeable membranes 122 divide the electrode chamber into two compartments 108 and 110. The membrane 122 is porous to sodium and chloride ions but is impervious to chlorine gas; thus, when the electric current is applied to the electrodes, chlorine gas is produced in the anode compartments and hydrogen gas and sodium hydroxide are produced at the cathode compartments. The chlorine gas passes through electrode indentations 106*b*, through holes 181 and into hollow tube 114 for whatever use may be made of it. Preferably, the gas will be passed directly into a body of water for disinfection or purification purposes; however, the gas can be collected and stored or used for any other purpose for which chlorine gas may be used. The products produced in the anode compartment, i.e., hydrogen gas and sodium hydroxide similarly flow through indentations 106*c* through hole 182 into hollow tube 113 and may be collected separately or passed into a body of water for any desired purpose.

Similarly to the operations described for FIGS. 1 and 2, if desired, the materials exiting through hollow tubes 113 and 114 may be intermixed, after allowing the gaseous hydrogen to escape, to form a hypochlorite solution. Thus, the degree of flexibility allowed by the construction of the unit shown in FIGS. 3 through 6 allows for the production and collection of separate products or the intermixing of said products.

The apparatus shown in the drawings and described above provides a simple compact and economical structure for producing chlorine gas and hypochlorite compounds. Arrangement of the carbon electrodes in series (as opposed to being arranged in parallel) enables the use of a high voltage and low current source of electricity. This in turn reduces the cost and complexity of the electricity handling devices since smaller voltage step-down transformers can be used and lower-rated current rectifiers can also be used. Also, with the configurations shown and described, the number of carbon electrodes and thus the chlorine gas or hypochlorite producing capacity of the apparatus can be easily varied simply by adding or subtracting carbon electrode discs.

It is to be understood that the above-described embodiments are only illustrative of the principles of the present invention. Other embodiments may be described by those skilled in the art without departing from the sphere and scope of the invention. For example, the cylindrical housing and carbon electrode discs could be replaced by other housings and electrodes of other shapes so long as the electrodes were coupled in series as generally described. The appended claims are intended to cover all embodiments which do not depart from the sphere and scope of the invention.

What is claimed is:

1. Apparatus for producing chlorine gas or a hypochlorite compound comprising a housing, one or more hollow tubes disposed in the housing and having a plurality of apertures spaced along the length of each tube, a plurality of carbon plate electrodes arranged in series in said housing, each having a hole or holes therein for receiving a tube or tubes therethrough, the planes defined by the plates being substantially parallel with each other and perpendicular with the tube or tubes, said plates being spaced to define chambers between adjacent plates, said chambers being located over one or more apertures in the tube or tubes, a plurality of chloride ion permeable membranes, each disposed in a different one of said chambers to divide said one chamber into an anode compartment and a cathode compartment, means for supplying an alkali or alkaline earth chloride solution to one hollow tube for transport to the chambers, means for applying a D.C. current to the electrodes, and means for collecting the products produced in the anode and cathode compartments.

2. Apparatus as in claim 1 further comprising a plurality of screens, each positioned in a different one of the compartments adjacent the surface of a corresponding electrode to thereby inhibit collection on the electrode of bubbles formed in the solution in the compartment.

3. Apparatus as in claim 1 for producing a hypochlorite having one hollow tube wherein said housing has an aperture contiguous with each chamber through which chlorine gas, hydrogen gas and an alkali or alkaline earth hydroxide may flow, and wherein said collecting means includes a jacket mounted on the exterior of the housing over the housing apertures wherein said chlorine gas and alkali or alkaline earth hydroxide are reacted to form an alkali or alkaline earth hypochlorite product which is then directed to a utilization means.

4. Apparatus as in claim 3 further comprising a plurality of fluid seals, each positioned in a different compartment to circumscribe the tube and to contact the carbon plate and interior surface of the housing to thereby seal the compartment and prevent the flow of solution or gas from the compartment through space between the carbon plate and interior surface of the housing.

5. Apparatus as in claim 4 wherein said seals comprise a salt brine solution resistant elastomer.

6. Apparatus as in claim 5 wherein said housing is cylindrically shaped and wherein said carbon plate electrodes comprise discs, each arranged coaxially with the other discs within the housing, the circumference of said discs being substantially the same as the interior circumference of said housing.

7. Apparatus as in claim 5 wherein the alkali or alkaline earth chloride is sodium chloride and the hypochlorite produced is sodium hypochlorite.

8. Apparatus as in claim 1 for producing chlorine gas having three hollow tubes extending through said carbon plate electrodes, one of said tubes extending through the lower portion of said carbon plate electrodes adapted to deliver an alkali or alkaline earth salt solution to each anode compartment, the second of said tubes extending through the top portion of said carbon plate electrodes adapted to remove chlorine gas formed in the anode compartment, and the third of said hollow tubes extending through an upper quadrant of said carbon electrode adapted to remove hydrogen gas and an alkali or alkaline earth metal hydroxide from each cathode compartment.

9. Apparatus as in claim 8 further comprising a plurality of fluid seals, each positioned in a different compartment to circumscribe the tubes and to contact the carbon plate electrodes and interior surface of the housing to thereby seal the compartment and prevent flow of solution or gas from the compartment through space between the carbon plate and interior surface of the housing and through the space between the exterior on the tubes and the interior surface of the holes in the carbon plate.

10. Apparatus as in claim 9 wherein each electrode surface forming part of the anode compartment has indentations adjacent the top and bottom holes through which extend the salt solution feed tube and the chlorine gas exit tube, said indentations and the apertures in said tubes being contiguous with each other.

11. Apparatus as in claim 10 wherein each electrode surface forming part of a cathode compartment has an indentation adjacent the hole through which extends the hydrogen gas and alkali or alkaline earth hydroxide exit tube, said indentation and apertures in said tube being contiguous with each other.

12. Apparatus as in claim 11 wherein said indentations extend past the fluid seals circumscribing said tubes.

13. Apparatus as in claim 12 wherein said fluid seals comprise a salt brine solution resistant elastomer.

* * * * *